US005531363A

United States Patent [19]

Gross et al.

[11] Patent Number: 5,531,363

[45] Date of Patent: Jul. 2, 1996

[54] DISPENSING CLOSURE CARTRIDGE VALVE SYSTEM

[75] Inventors: Richard A. Gross, Brookfield; Eldon W. Schaffer, II, East Troy, both of Wis.

[73] Assignee: Aptargroup, Inc., Crystal Lake, Ill.

[21] Appl. No.: 258,659

[22] Filed: Jun. 10, 1994

[51] Int. Cl.[6] ..... B65D 5/72

[52] U.S. Cl. ..... 222/494; 222/541.9; 222/547

[58] Field of Search ..... 222/490, 494, 222/212, 541.9, 545, 556, 547, 564

[56] References Cited

U.S. PATENT DOCUMENTS

| | | | |
|---|---|---|---|
| 1,607,993 | 11/1926 | Loewy . | |
| 1,658,233 | 2/1928 | Falk . | |
| 1,739,871 | 12/1929 | Smith . | |
| 1,748,682 | 2/1930 | Smith . | |
| 1,825,553 | 9/1931 | Smith . | |
| 1,989,145 | 1/1935 | Newby . | |
| 1,989,714 | 2/1935 | Statham . | |
| 1,996,156 | 4/1935 | Janssen . | |
| 2,061,124 | 11/1936 | Walther . | |
| 2,591,354 | 4/1952 | Harris . | |
| 2,679,954 | 6/1954 | Barnes . | |
| 2,688,979 | 9/1954 | Kendrick . | |
| 2,705,085 | 3/1955 | Glensky | 215/42 |
| 2,720,881 | 10/1955 | Jones . | |
| 2,743,852 | 5/1956 | Slberdi, Jr. . | |
| 2,758,755 | 8/1956 | Schafler . | |
| 2,787,394 | 4/1957 | Baumann | 215/46 |
| 2,802,607 | 8/1957 | Kalmbach, Jr. et al. . | |
| 2,937,795 | 5/1960 | Ciliberti . | |
| 2,941,544 | 6/1960 | Peras . | |
| 2,942,762 | 6/1960 | Fahr . | |
| 3,067,787 | 12/1962 | Salk . | |
| 3,165,241 | 1/1965 | Curry . | |
| 3,179,301 | 4/1965 | Lucht . | |
| 3,257,046 | 6/1966 | Kasson . | |
| 3,258,028 | 6/1966 | Donner . | |
| 3,270,771 | 9/1966 | Morgan et al. . | |
| 3,281,000 | 10/1966 | Lowen . | |
| 3,366,261 | 1/1968 | Dewey . | |
| 3,669,323 | 6/1972 | Harker et al. . | |
| 3,674,183 | 7/1972 | Venable et al. . | |
| 3,726,436 | 4/1973 | Despain et al. . | |
| 3,795,558 | 3/1974 | Dabney et al. . | |
| 4,036,412 | 7/1977 | Craig . | |
| 4,109,836 | 8/1978 | Falarde . | |
| 4,133,457 | 1/1979 | Klassen . | |
| 4,269,330 | 5/1981 | Johnson . | |
| 4,513,891 | 4/1985 | Hain et al. . | |
| 4,616,768 | 10/1986 | Flier . | |
| 4,620,648 | 11/1986 | Schwartzman . | |
| 4,646,945 | 3/1987 | Steiner et al. . | |
| 4,682,702 | 7/1987 | Gach | 215/232 |
| 4,728,006 | 3/1988 | Drobish et al. . | |
| 4,735,334 | 4/1988 | Abbott . | |
| 4,749,108 | 6/1988 | Dornsbusch et al. . | |
| 4,760,937 | 8/1988 | Evezich . | |
| 4,776,495 | 10/1988 | Vignot . | |
| 4,874,369 | 10/1989 | Kulle et al. . | |

(List continued on next page.)

FOREIGN PATENT DOCUMENTS

| | | |
|---|---|---|
| 251478 | 5/1967 | Austria . |
| 0253495A2 | 1/1988 | European Pat. Off. . |
| 673584 | 1/1930 | France . |
| 2354093 | 3/1975 | Germany . |
| 8814121 | 4/1989 | Germany . |
| 344215 | 8/1928 | United Kingdom . |
| 1474620 | 5/1977 | United Kingdom . |
| WO94/05552 | 2/1994 | WIPO . |

*Primary Examiner*—Gregory L. Huson

*Attorney, Agent, or Firm*—Dressler, Goldsmith, Shore & Milnamow, Ltd.

[57] ABSTRACT

A cartridge for a closure, and a closure containing such a cartridge, are provided for accommodating the dispensing of a liquid product from a container. The cartridge includes a body, a valve seated in the body, and a retainer engaged with the body to hold the retainer and body in a clamping relationship retaining the valve in position on the body. A standardized valve and overall cartridge design may be employed with a variety of different closure housings for different containers.

16 Claims, 9 Drawing Sheets

U.S. PATENT DOCUMENTS

| | | | |
|---|---|---|---|
| 4,922,955 | 5/1990 | Uri . | |
| 4,952,114 | 6/1990 | Morse et al. . | |
| 4,969,581 | 11/1990 | Seifert et al. . | |
| 4,991,745 | 2/1991 | Brown . | |
| 5,005,737 | 4/1991 | Rohr . | |
| 5,033,647 | 7/1991 | Smith et al. . | |
| 5,033,655 | 7/1991 | Brown . | |
| 5,115,950 | 5/1992 | Rohr . | |
| 5,123,561 | 6/1992 | Gross | 220/254 |
| 5,213,236 | 5/1993 | Brown et al. . | |
| 5,234,138 | 8/1993 | Laforcade | 222/490 |
| 5,271,531 | 12/1993 | Rohr et al. . | |
| 5,307,955 | 5/1994 | Viegas | 222/107 |
| 5,339,995 | 8/1994 | Brown et al. | 222/185 |

FIG. 12
FIG. 11
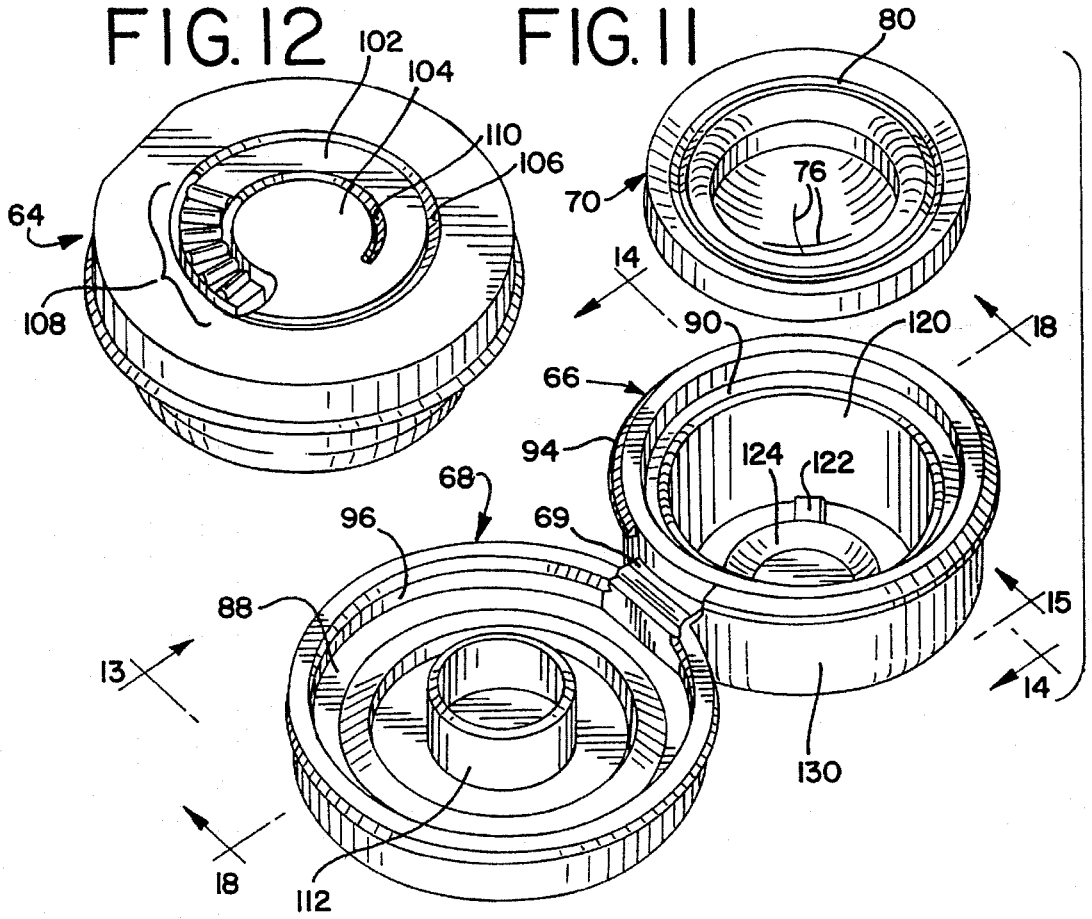
FIG. 13
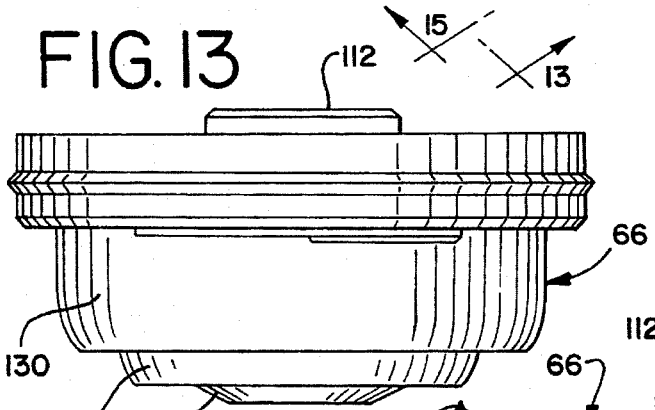
FIG. 14
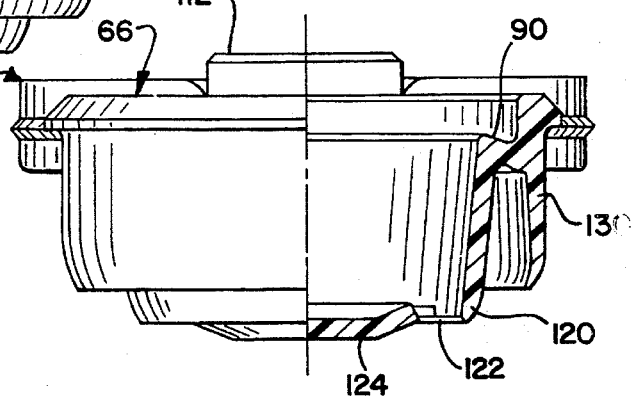

FIG. 24
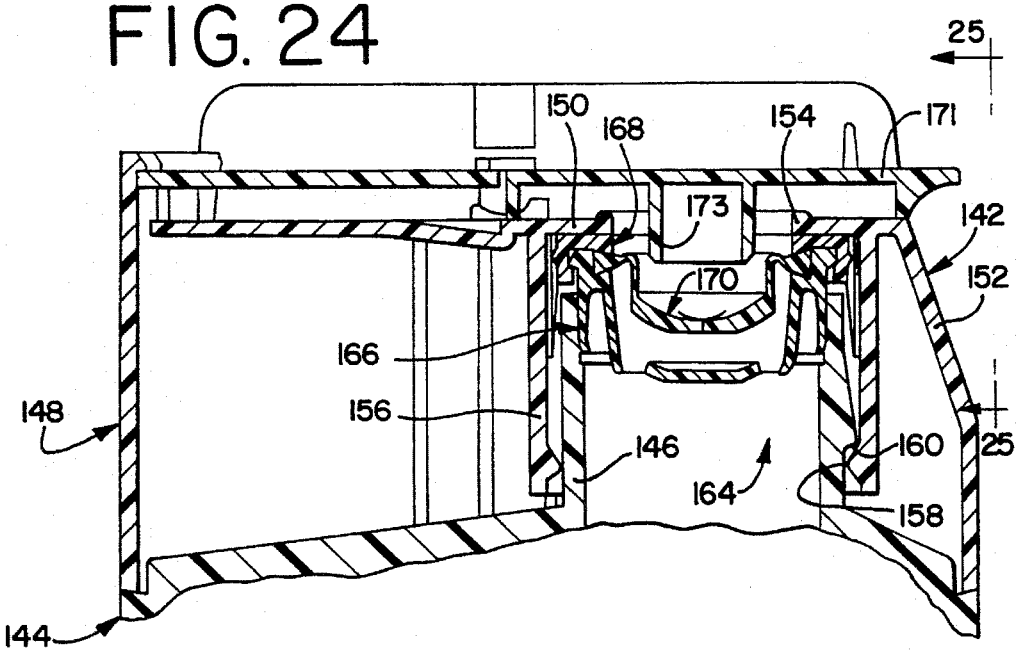
FIG. 25
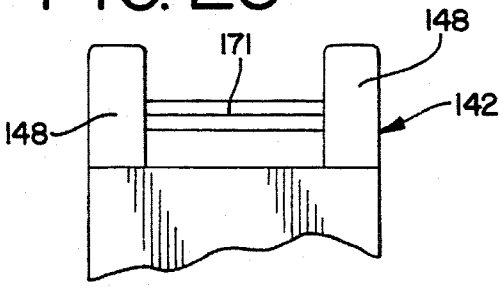
FIG. 26
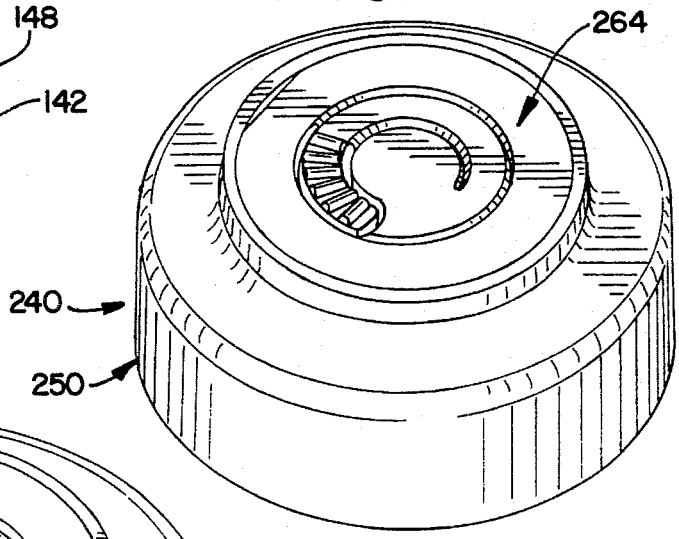
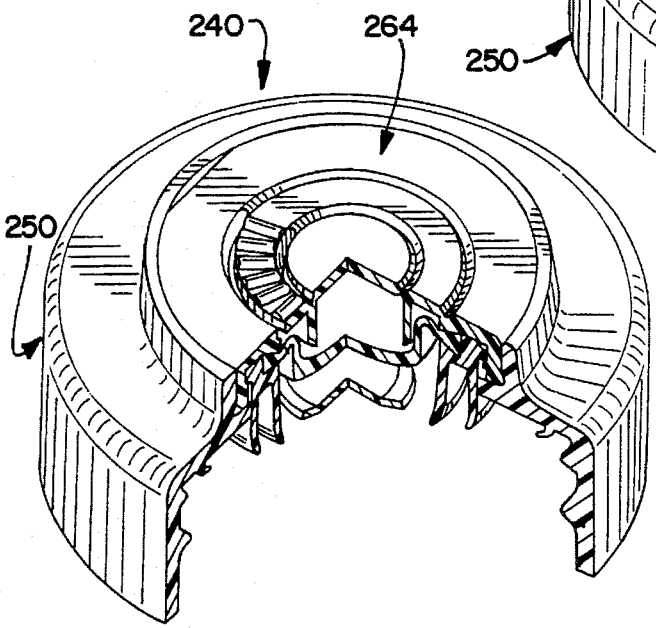
FIG. 27

DISPENSING CLOSURE CARTRIDGE VALVE SYSTEM

TECHNICAL FIELD

This invention relates to container closures, and more particularly to a squeeze-type container dispensing closure having a valve which opens to dispense a fluid product from the container when the container is squeezed and which automatically closes when the squeezing pressure is released.

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other fluid materials. One type of closure for these kinds of containers typically has a flexible, self-sealing, slit-type dispensing valve mounted over the container opening. When the container is squeezed, the fluid contents of the container are discharged through the valve.

Closure designs have been proposed for such valves, and examples are illustrated in the U.S. Pat. No. 5,271,531. Typically, the closure includes a base or housing defining a seat for receiving the valve and includes a retaining ring or clamp structure for holding the valve on the seat in the housing. These components are typically unique with respect to the size and style of the individual closure design which is configured to be mounted on, and coordinated with, a particular container.

It would be desirable, however, to provide an improved system in which the number of components could be reduced and/or in which the component design could be simplified to reduce manufacturing costs.

It would be particularly desirable to provide a system which could employ one or more standardized components and which would require only one, mating component to have non-standard design for attachment to a container of a specific design.

Additionally, it would be beneficial if closure components could be provided with a simplified system for retaining the slit valve and for providing a means for conveniently handling the slit valve during assembly in the closure. It would be especially advantageous to provide an improved system that could eliminate the requirement for using expensive, specialized assembly machines designed to handle such slit valves and which generally operate at a relatively low production speed.

Further, it would also be desirable to provide an improved design which could accommodate the use of a tear-away seal, including a tamper-evident type seal.

Further, it would be advantageous if such an improved closure could provide means for preventing discharge of the container product through the valve during over-pressure events, such as when the container is subjected to high impact forces that might cause the valve to open.

Additionally, it would be desirable if such an improved closure could be provided with a design that would accommodate efficient, high quantity, manufacturing techniques with a reduced product reject rate.

Further, such an improved closure should advantageously accommodate its use with a variety of conventional containers having a variety of conventional container finishes, such as conventional threaded and snap-fit attachment configurations.

The present invention provides an improved closure and closure components which can accommodate designs having the above-discussed benefits and features.

SUMMARY OF THE INVENTION

One aspect of the present invention includes a cartridge for being received in a hollow closure housing that is suitable for engagement with a container around an opening to the container interior.

The cartridge includes a body defining a dispensing passage for communicating with the container exterior and interior when the cartridge is received in the housing on the container.

A valve is seated on the body for shifting between a closed configuration occluding the passage and an open configuration accommodating the dispensing of the container contents through the passage.

A retainer is engaged with the body to hold the retainer and body in a clamping relationship that retains the valve in position in the body. The retainer and the body cooperate to maintain the engagement independently of the housing.

A further aspect of the invention provides a closure which includes a body for mounting to the container at the opening of the container. The body defines a dispensing passage for communicating between the container exterior and interior.

A valve is seated in the body for shifting between a closed configuration occluding the passage and an open configuration accommodating dispensing of the container contents through the passage. Molded unitary with the body are a hinge and a retainer extending from the hinge. The retainer is engaged with the body at at least one location separate from the hinge to hold the retainer and body in a clamping relationship retaining the valve in position in the body.

Still another aspect of the invention provides a closure having a hollow housing for engaging the container around the container opening. The housing defines an interior receiving structure. A cartridge is disposed in the housing receiving structure.

The cartridge includes a body defining a dispensing passage for communicating with the container exterior and interior when the cartridge is received in the housing on the container. A valve is seated in the body for shifting between a closed configuration occluding the passage and an open configuration accommodating the dispensing of the container contents through the passage. A retainer is engaged with the body to hold the retainer and body in a clamping relationship that retains the valve in position in the body. The retainer and body cooperate to maintain the engagement independently of the housing.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 11 is an exploded, perspective view of the cartridge components employed in the first embodiment of the closure illustrated in FIG. 1 and other figures;

FIG. 12 is a perspective view of the cartridge of FIG. 11 in a latched closed condition prior to assembly in the housing of the first embodiment of the closure illustrated in FIG. 1 and other figures;

FIG. 13 is a side, elevational view of the open, unassembled cartridge taken generally along the plane 13—13 in FIG. 11;

FIG. 14 is a partial cross-sectional view taken generally along the plane 14—14 in FIG. 11;

FIG. 24 is a fragmentary, cross-sectional view of a third embodiment of a closure of the present invention;

FIG. 25 is a fragmentary, side elevational view taken generally along the plane 25—25 in FIG. 24;

FIG. 26 is a perspective view of a fourth embodiment of a closure of the present invention;

FIG. 27 is a view similar to FIG. 26, but FIG. 27 shows a portion of the closure cut away to illustrate interior detail;

FIG. 31 illustrates further modifications in phantom by dashed lines.

DESCRIPTION OF THE PREFERRED EMBODIMENTS

Figure 1:
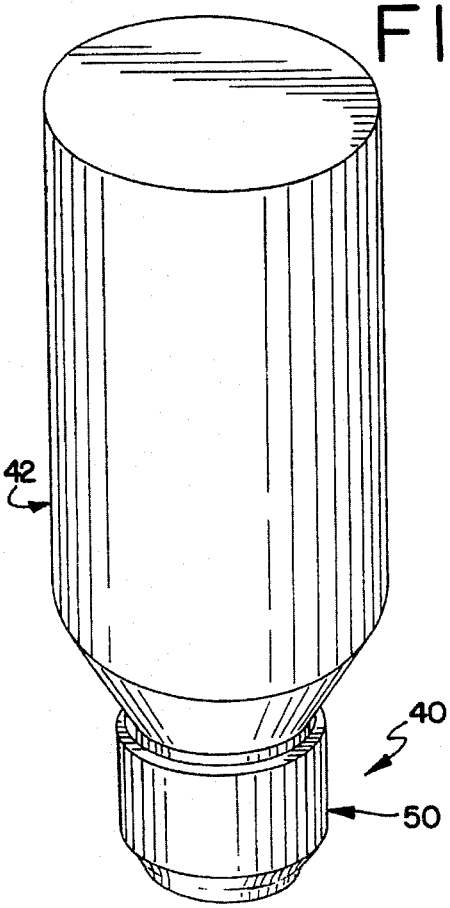
FIG. 1 is a perspective view of a container with a first embodiment of a closure in accordance with the teachings of one aspect of the present invention.
Figure 2:
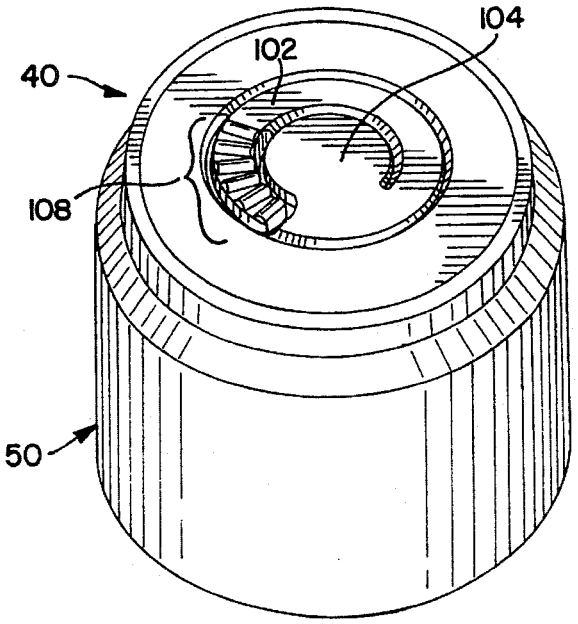
FIG. 2 is an enlarged, perspective of the closure illustrated in FIG. 1, but the closure is shown inverted relative to the position in FIG. 1.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure system of this invention is described in various positions, and terms such as upper, lower, horizontal, etc., are used with reference to these positions. It will be understood, however, that the closure components may be manufactured and stored in orientations other than the ones described.

With reference to the figures, a first embodiment of a closure that includes components of the present invention is illustrated in FIGS. 1–22 and is represented generally in many of those figures by reference numeral 40. The closure 40 is adapted to be disposed on a container, such as a container 42 (FIGS. 1 and 5) which has a conventional mouth or opening formed by a neck 44 (FIG. 5) or other suitable structure. The closure 40 may be fabricated from a thermoplastic material, or other materials, compatible with the container contents.

The container 42 is normally stored and used in the orientation shown in FIG. 1 wherein the closure 40 is at the bottom of the container 42. When stored, the container employs the closure 40 as a support base.

The container 42 is a squeezable container having a flexible wall or walls which can be grasped by the user and compressed to increase the internal pressure within the container so as to squeeze the product out of the container when the closure is opened (as explained in detail hereinafter). The container wall typically has sufficient, inherent resiliency so that when the squeezing forces are removed, the container wall returns to its normal, unstressed orientation.

Figure 3:
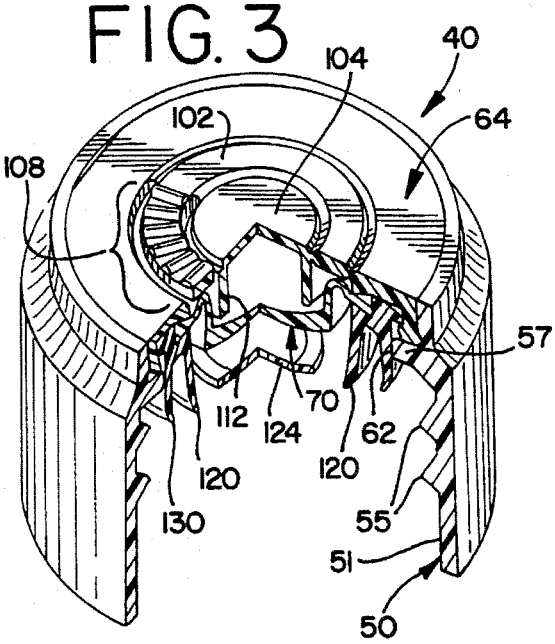
FIG. 3 is a view similar to FIG. 2, but with portions cut away to illustrate interior detail.
Figure 4:
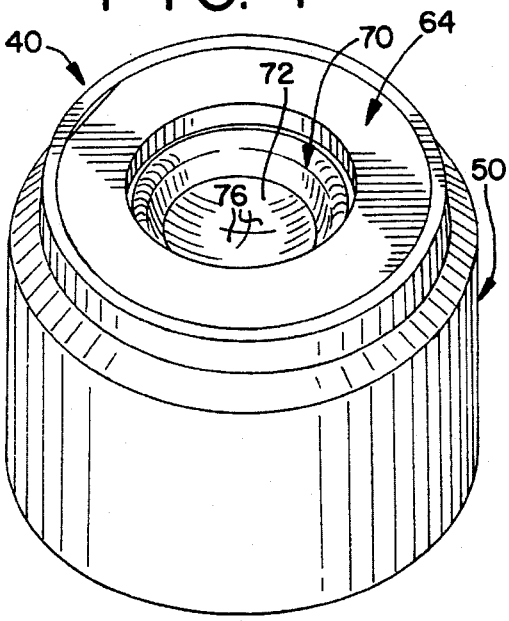
FIG. 4 is a fragmentary view similar to FIG. 2, but FIG. 4 shows the tamper-evident seal removed.
Figure 5:
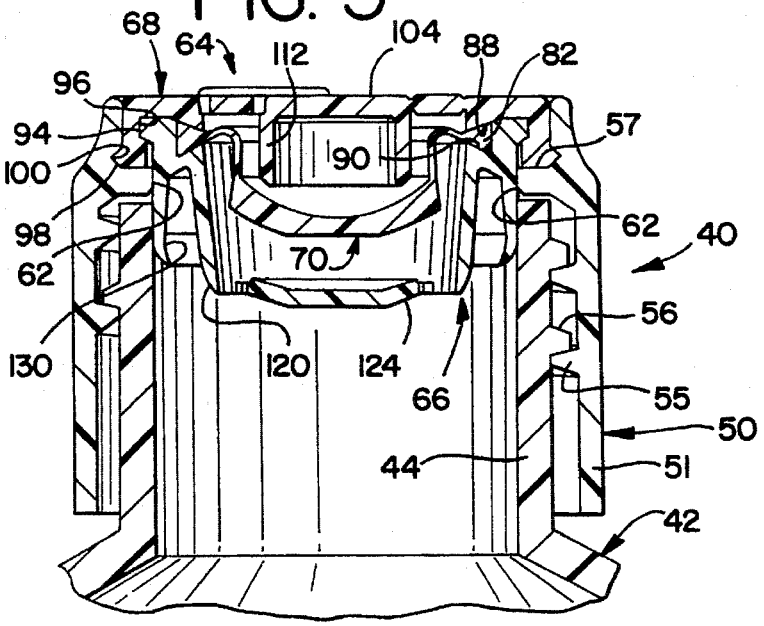
FIG. 5 is a fragmentary, cross-sectional view of the closure in place ion the container as shown in FIG. 1, but with the container inverted from the position shown in FIG. 1.

The closure 40 includes a hollow housing 50 (FIGS. 1–5). In the illustrated embodiment, the housing 50 includes a peripheral wall in the form of a generally cylindrical skirt or collar 51 (FIGS. 3 and 5). The interior surface of the collar 51 has a conventional thread 55 or other suitable means (e.g., a snap-fit bead (not illustrated)) for engaging suitable cooperating means, such as a thread 56 that is typically provided on the container neck 44 to releasably secure the housing 50 to the container.

The housing 50 includes a recessed annular flange 57 for receiving an insert or cartridge 64 which controls flow out of the container 42.

The central deck 57 (FIG. 5) defines a dispensing opening or passage 62 (FIGS. 3, 5, 9, and 10). The dispensing passage 62 establishes communication between the container interior and exterior through the container opening defined by the container neck 44.

The housing 50, at the region of the flange 57, defines an interior receiving area or structure for a novel, standardized cartridge 64 (FIGS. 3, 5, And 12). The cartridge 64 is adapted to be engaged with the housing 50 and retained therein. The cartridge 64, as illustrated in FIG. 12, has an assembled, closed configuration which is adapted to be received in the housing 50. As illustrated in FIG. 11, the cartridge is initially fabricated in an "open" condition and includes a body 66 and a cover or retainer 68. In the preferred embodiment illustrated, the body 66 and retainer 68 are molded from a suitable thermoplastic material as a unitary structure with a hinge 69 extending between, and connecting, the body 66 and retainer 68.

In one presently contemplated embodiment, the body 66, retainer 68, and hinge 69 may be molded from polyethylene or polypropylene as a unitary structure in the open configuration substantially as illustrated in FIGS. 11, 13, 14, 15, 16, 17, and 18.

The cartridge 64 also includes a flexible, resilient, slit-type dispensing valve 70 (FIG. 11) which is mounted in the housing 66 and retained therein by the retainer 68 when the cartridge is in the closed configuration (FIG. 12).

The valve 70 is mounted at the passage 62 inwardly of the central deck 57 as illustrated in FIG. 3. The valve 70 may be fabricated from thermosetting elastomeric materials such as silicone, natural rubber, and the like. It is also contemplated that the valve 70 may be fabricated from thermoplastic elastomers based upon materials such as thermoplastic propylene, ethylene, urethane, and styrene, including their halogenated counterparts.

Figure 6:
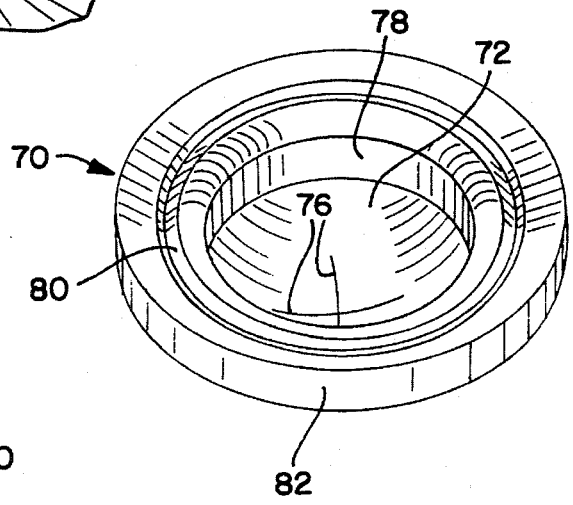
FIG. 6 is a perspective view of the slit valve removed from the closure illustrated in FIG. 5.
Figure 7:
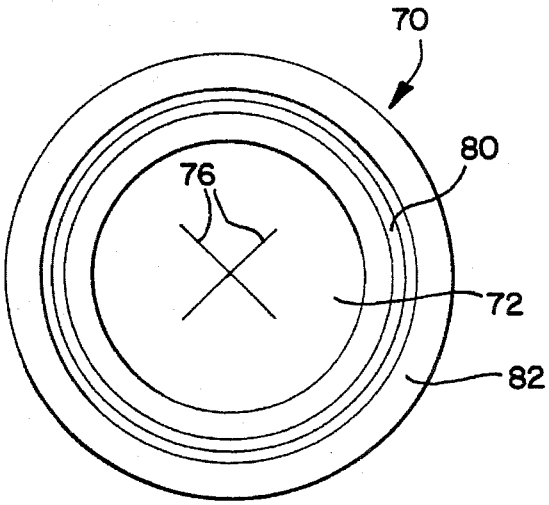
FIG. 7 is a top plan view of the valve shown in FIG. 6.
Figure 8:
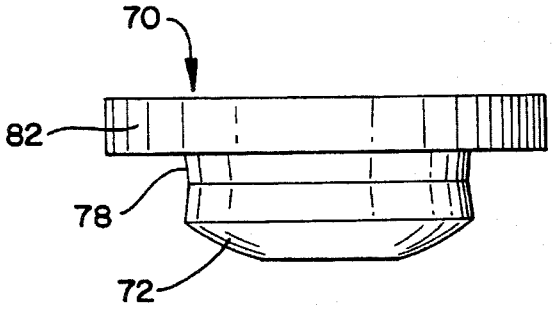
FIG. 8 is a side elevational view of the valve shown in FIG. 6.

As illustrated in FIGS. 6–8, the valve 70 includes a flexible, central wall 72 which has an outwardly concave configuration and which defines at least one, and preferably two, dispensing slits 76 extending through the central wall 72. A preferred form of the valve has two, mutually perpendicular, intersecting slits 76 of equal length. The intersecting slits 76 define four, generally pie-shaped, flaps or petals in the concave, central wall 72 which each open outwardly from the intersection point in response to increasing pressure of sufficient magnitude in the well-known conventional manner.

The valve 70 includes a skirt 78 which extends outwardly from the valve central wall 72. At the outer (upper) end of the skirt 78 there is a thin, annular flange 80 (FIGS. 6 and 7) which extends peripherally from the skirt 78 in a downwardly angled orientation. The thin flange 80 terminates in an enlarged, much thicker, peripheral flange 82 which has a generally dovetail shape transverse cross section.

The valve 70 is disposed in the cartridge body 66 and is clamped therein by the retainer 68 which is closed over the top of the valve 70 to form the fully assembled cartridge as shown in FIGS. 5 and 12.

To accommodate the seating of the valve 70 in the cartridge, the underside of the cartridge cover or retainer 68 defines an annular, downwardly facing, angled clamping surface 88 (FIGS. 5 and 11) for engaging the top of the valve flange 82.

The bottom of the valve flange 82 is engaged by an annular shoulder in the body 66 which defines an upwardly angled seating surface 90.

The spacing between the clamping and seating surfaces 88 and 90, respectively, increases with increasing radial distance from the center. Such a configuration defines a cavity with a transverse cross section having a dovetail shape which generally conforms to the shape of the valve flange 82.

This clamping arrangement securely holds the valve 70 in the cartridge body 40 without requiring special internal support structures or bearing members adjacent the interior surface of the valve cylindrical skirt 78. This permits the region adjacent the interior surface of the valve skirt 78 to be substantially open, free, and clear so as to accommodate movement of the valve skirt 78.

When the valve 70 is properly mounted within the body 66 as illustrated in FIGS. 3 and 4, the valve 70 is recessed relative to an outer, top, peripheral surface of the cartridge 64. This affords substantial protection to the valve and generally reduces the likelihood that the valve will be inadvertently contacted or damaged by external instrumentalities when the closure is opened but not dispensing product. However, as explained in detail hereinafter, when the product is dispensed through the valve 70, the valve is displaced outwardly from the recessed position. The capability of the valve to be displaced outwardly offers certain advantages discussed below.

The cartridge body 66 and retainer 68 have exterior configurations permitting the retainer and body to be held together in the closed configuration (FIG. 12). In particular, the body 66 has an annular bead defining a convex surface 94 (FIG. 18) extending radially outwardly around the periphery of the upper edge of the body. The retainer 68 defines an annular groove 96 (FIGS. 5, 9, and 18) for receiving the body bead 94 in a snap-fit engagement when the retainer 68 is closed over the installed valve 70.

The cartridge 64 is adapted to be engaged with the closure housing 50. To this end, the retainer 68 has an outwardly projecting, annular bead 98, and the housing 50 defines an inwardly open, annular groove 100 (FIGS. 5 and 9) for receiving the cartridge retainer bead 98 when the closed cartridge is disposed within the housing in a snap-fit engagement adjacent the central deck flange 57.

The cartridge 64 preferably includes a tear-away, tamper-evident seal which includes a pull tab 102 (FIGS. 2, 3, 12, 16, 17, 18, and 22) with an end grip 108. The pull tab 102 is defined around a central panel 104 (FIGS. 2, 3, 16, and 17). The central panel 104 has a generally circular, disc-like configuration and is joined to the peripheral portion of the retainer 68 with a frangible web of material designated in FIGS. 16 and 17 by the reference number 106. An inner portion of the pull tab 102, for about a 180° arc length inwardly of the pull tab 102, is connected via a frangible web 110 to the retainer central portion 104.

Figure 16:
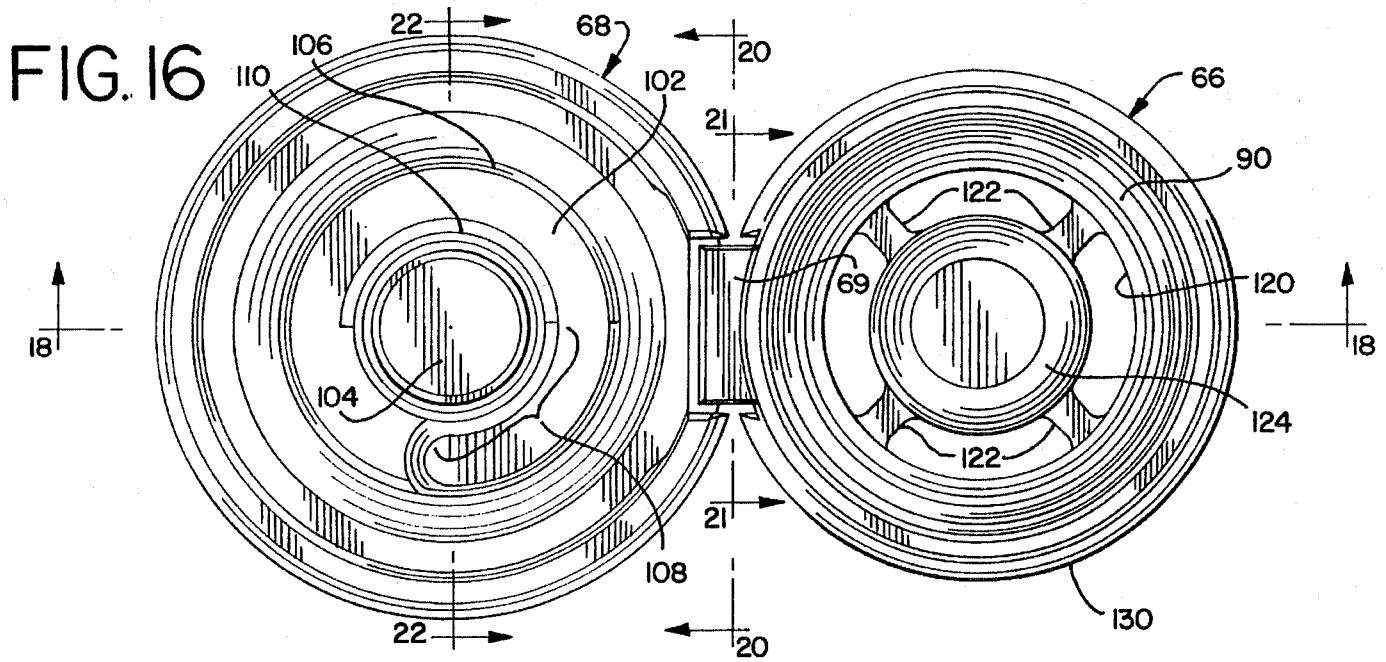
FIG. 16 is a view taken generally along the plane 16—16 in FIG. 15.
Figure 15:
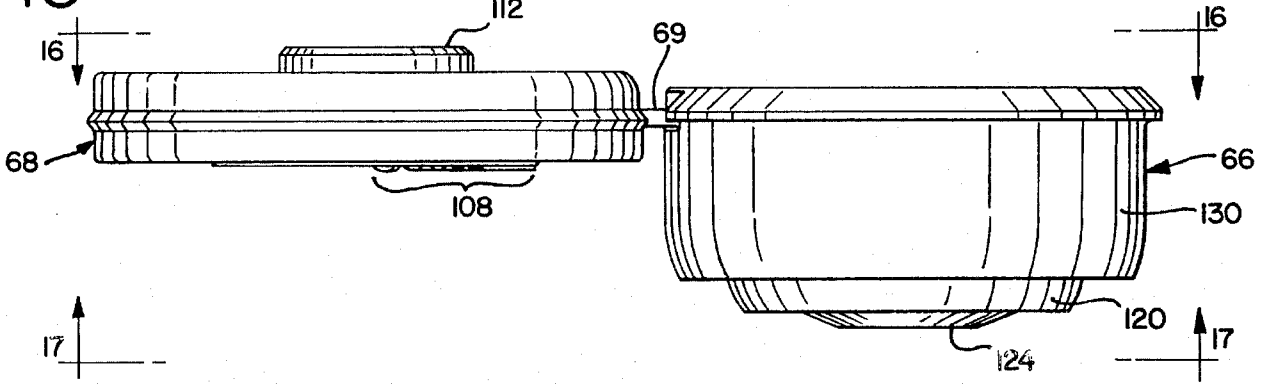
FIG. 15 is a view taken generally along the plane 15—15 in FIG. 11.
Figure 18:
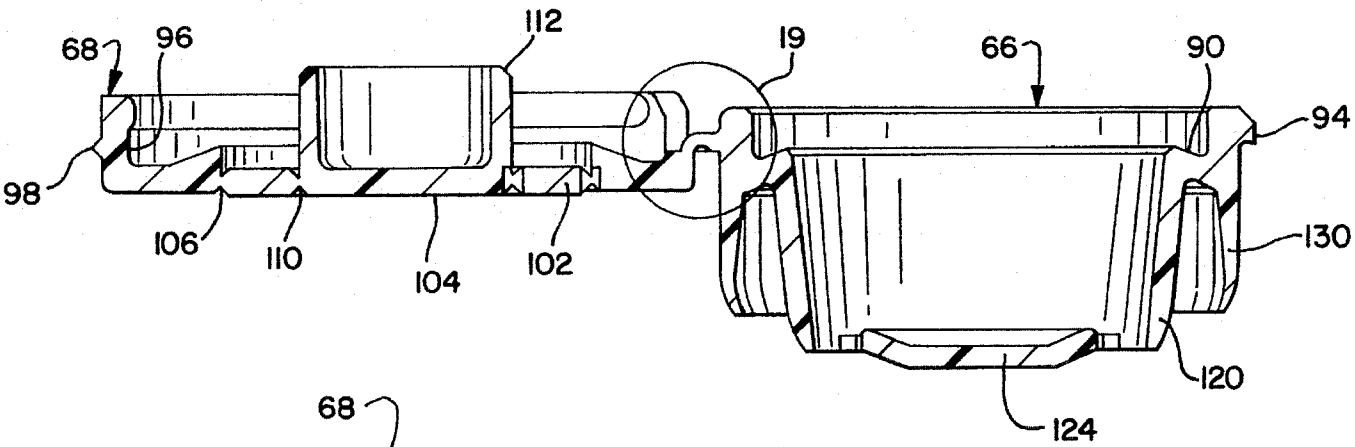
FIG. 18 is a cross-sectional view taken generally along the plane 18—18 in FIG. 16.
Figure 17:
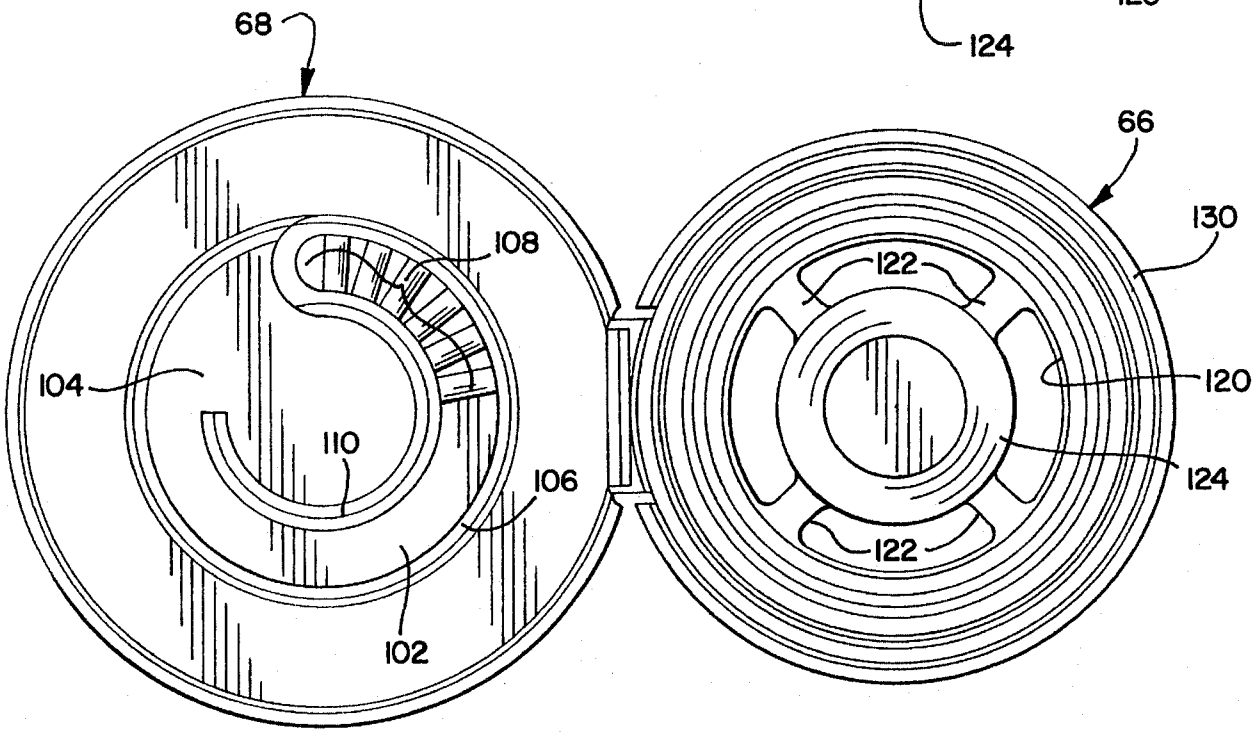
FIG. 17 is a view taken generally along the plane 17—17 in FIG. 15.
Figure 19:
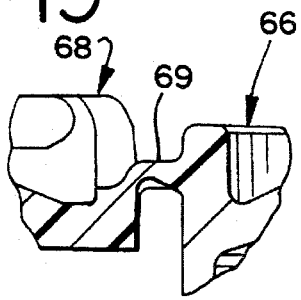
FIG. 19 is a greatly enlarged, fragmentary, cross-sectional view taken at the encircled area designated by reference number 19 in FIG. 18.
Figure 20:
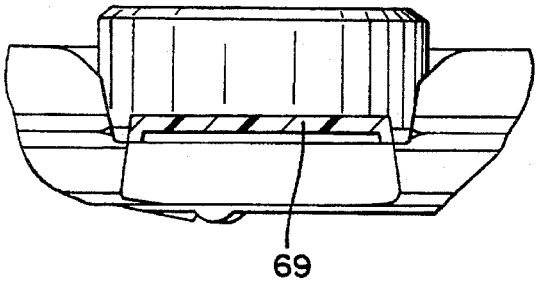
FIG. 20 is a fragmentary, enlarged, cross-sectional view taken generally along the plane 20—20 in FIG. 16.
Figure 21:
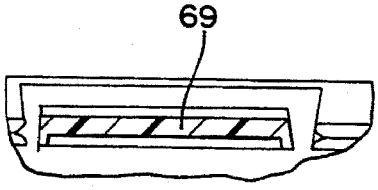
FIG. 21 is a fragmentary, enlarged, cross-sectional view taken generally along the plane 21—21 in FIG. 16.

As illustrated in FIGS. 16 and 17, the frangible web extends approximately 270° around the outside edge of the pull tab 102. There is an approximately 90° arc adjacent the outside edge of the end grip portion 108 (FIG. 17) which is open so that there is no connection between the grip portion 108 and the outer periphery of the retainer 68. There is also an opening at the end of the grip portion 108 and on the inside radius of the grip portion 108. The grip portion 108 is thus not attached at its periphery to the adjacent, but spaced-away, portions of the retainer. This allows the grip portion 108 to be grasped and pulled upwardly.

Figure 22:
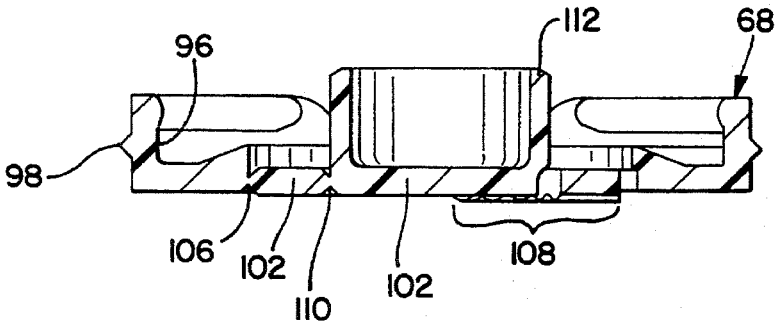
FIG. 22 is a cross-sectional view taken generally along the plane 22—22 in FIG. 16.

The frangible webs 106 and 110 are preferably defined by a reduced-thickness portion of the material. As illustrated in FIG. 22, the top surface and the bottom surface of the retainer 68 may be provided with grooves or notches for defining the reduced-thickness frangible web regions 106 and 110.

In order to open the seal, the grip portion 108 is grasped between the thumb and index finger, and the grip portion 108 is then pulled outwardly. The central portion 104 pulls away from the center of the retainer 68 as the frangible webs 110 and 106 are torn. When the central portion 104 is completely torn away, the valve 70 is exposed as illustrated in FIG. 4.

When the closure 40 is in the closed configuration, before the central portion 104 is torn away, it is desirable to provide a valve restraint member to prevent actuation or opening of the valve. When the container is not being used to dispense product, the container could be inadvertently subjected to external forces (such as impact forces during handling or shipping), and these forces could increase the internal pressure in the container. This could cause the valve to open. To eliminate this potential problem, an annular restraint wall 112 (FIGS. 5, 9 and 18) is provided on the inside of the retainer central portion 104 adjacent the valve central wall 72. This prevents the valve central wall 72 from moving or articulating sufficiently outwardly to open the dispensing slits 76.

Preferably, the cartridge 64 also includes an inwardly extending wall 120 (FIGS. 3, 5, 9, 16, 17, and 18). Projecting radially inwardly from the distal end of the wall 120 are four arms 122 (FIGS. 16 and 17) which support a centrally disposed baffle plate 124.

The cartridge 64 also includes an outer seal wall 130 (FIGS. 3, 5, 9, 10, 11, 13, 14, 15, 16, 17, and 18). As illustrated in FIG. 5, the exterior surface of the seal wall 130 is received within the container neck 44 and seals against the cylindrical interior surface of the neck 44. Preferably, at least a distal annular portion of the seal wall 130 is somewhat resilient so as to provide a leak-tight seal between the cartridge and the container neck.

The product within the container 42 can be dispensed from the container by squeezing the container sufficiently to force the product through the valve 70. Typically, this is effected by first inverting or tilting the container 42 so that the valve 70 is oriented to discharge generally downwardly. Typically, the liquid within the container flows downwardly, under the influence of gravity, and fills the container neck region. The liquid flows past the baffle 124 and against the inside of the valve central wall 72. The valve 70 is preferably designed so that the weight of the liquid will not deflect the valve downwardly under normal, static conditions. The valve will thus be spaced away from the annular restraint wall 112 as shown in FIG. 5 (except that the container would be inverted).

Figure 9:
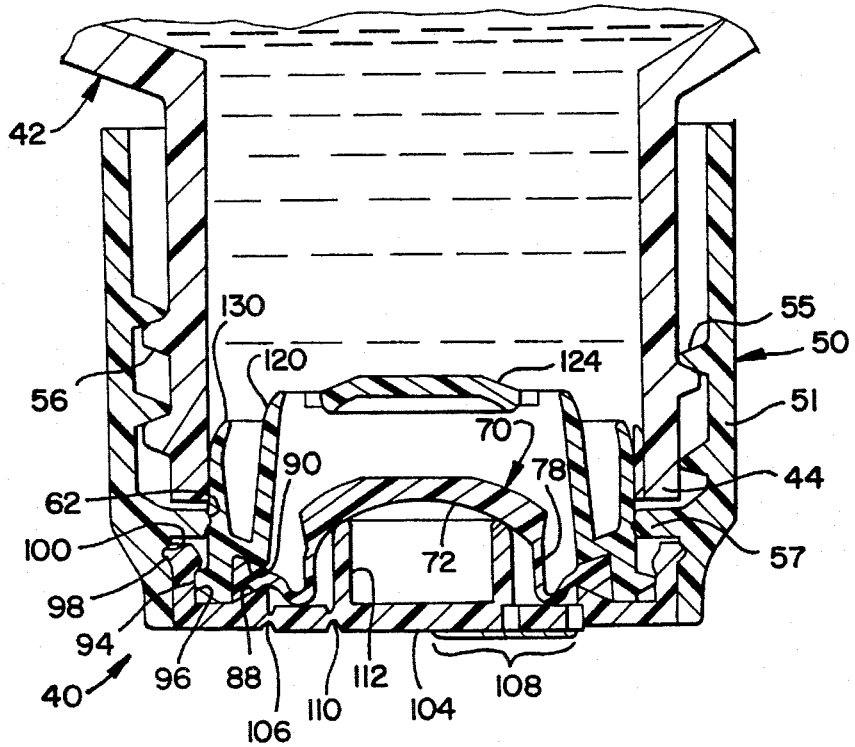
FIG. 9 is a view, similar to FIG. 5, but the closure is shown in FIG. 9 inverted relative to the orientation shown in FIG. 5 and is shown with the container contents filling the container neck and subjected to a transient overpressure condition.

However, if the internal pressure within the container is increased temporarily (as shown in FIG. 9), then the increased pressure (which could also include the weight of the liquid within the container if the container was inverted) could deflect the valve central wall 72 downwardly against the distal end of the outwardly projecting annular restraint member 112. This might occur, for example, if the external pressure were suddenly reduced (e.g., during transport in an airplane, or if the container were subjected to an external impact force). The annular restraint wall 112 prevents the valve 70 from moving sufficiently outwardly to open the dispensing slits 76 under such conditions.

Figure 10:
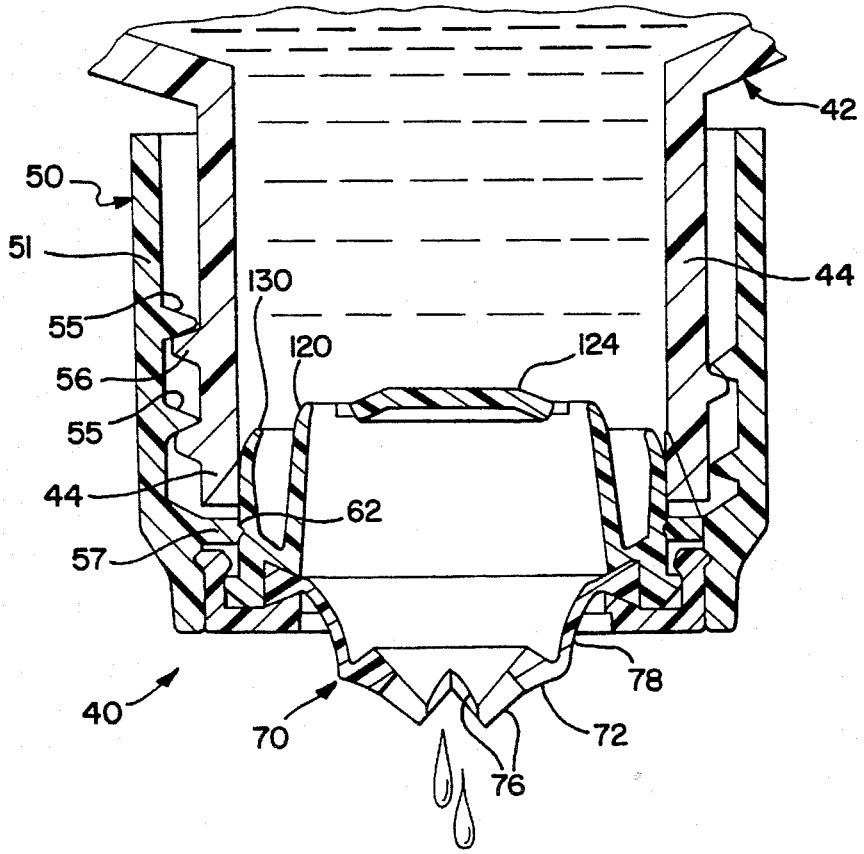
FIG. 10 is a view similar to FIG. 9, but FIG. 10 shows the closure opened with the container pressurized, as by squeezing, to dispense liquid product through the open closure.

If the closure is subsequently opened by tearing away the pull tab 102 and central portion 104, then an increase in the internal pressure in the container, as by squeezing the container, will cause the valve to open as illustrated in FIG. 10. When the valve is subjected to an increased container pressure, the valve central wall 72 is displaced outwardly while still maintaining its generally concave configuration. The outward displacement of the concave, central wall 72 is accommodated by the relatively thin, flexible, skirt 78. The skirt 78 moves from a rest position (FIG. 5) to the pressurized position (FIG. 10) wherein the skirt is projecting outwardly through, and beyond, the dispensing opening.

The valve 70 does not open (i.e., the slits 76 do not open) until the valve central wall 72 has moved substantially all the way to the outermost position. Indeed, as the valve central wall 72 moves outwardly, the central wall 72 is subjected to radially inwardly directed compression forces which tend to further resist opening of the slits 76. Further, the central wall 72 generally retains its outwardly concave configuration as it moves forward and even after it reaches the outermost position (FIG. 10). If the internal pressure is sufficiently great, then the slits 76 begin to open to dispense product as diagrammatically illustrated in FIG. 10.

Because the valve central wall 72 is located at its outermost position when dispensing product, the dispensing process can be more easily observed by the user. Further, because the valve dispenses product when it is in the outermost position and not in the recessed position (FIG. 5), the valve can be more easily directed to dispense the product at a selected target site.

It will be appreciated that the baffle plate 124 functions to minimize undesirable impacts on the inside of the valve 70, as when the container is being squeezed excessively hard or shaken. The baffle plate 124 also functions in this manner even when the closure is sealed closed with the annular restraint member 112 in place.

Further, it will be appreciated that when the annular restraint member 112 is in place, and when pressure transients force the valve 70 against the restraint member 112, the restraint member also functions, in addition to preventing excessive movement of the valve 70 toward the open position, as a seal on the outer surface of the valve central wall 72. Thus, should a small quantity of liquid leak through the valve slits during a transient over-pressure condition, the sealing engagement illustrated in FIG. 9 will at least initially contain the leaking product on the inside of the annular restraint member 112.

A variety of different sizes and shapes of containers can be readily provided with a closure 40 having a standardized cartridge 64. The cartridge, including the valve 70, can be provided in one, universal design having a standard shape and standard dimensions. The inside of the closure housing 50 can be provided with a receiving region of a standard shape and size for the standard cartridge 64. Thus, only the housing skirt 51 need be changed as necessary to accommodate a container neck having a particular size and shape.

Further, the use of a standard cartridge with a standard valve permits the use of a single manufacturing process to assemble the valve in the cartridge. The cartridge can thereafter be readily handled at a high rate of speed by automatic machinery which installs the cartridge in the closure housing. This eliminates the need for directly handling a small, flexible valve during installation in a larger closure housing.

The use of a unitary cartridge, which includes the unitary body, hinge, and retainer, minimizes the number of separate parts that must be handled. Further, the snap-engagement of the cartridge retainer with the cartridge body over the body flange permits a relatively rapid and efficient assembly process for capturing the valve. Subsequently, the snap-fit engagement of the cartridge in the closure housing accommodates relatively high speed production with a minimum product reject rate.

Further, the use of a separate cartridge easily accommodates the creation of a multi-color closure. The cartridge can be fabricated in one color, and the closure housing can be molded in another color.

If desired, the tear-away tab 102 and central portion 104 may be completely eliminated. In such a case, the closure would have the appearance as shown in FIG. 4, and the valve 70 would be exposed at all times.

Figure 23:
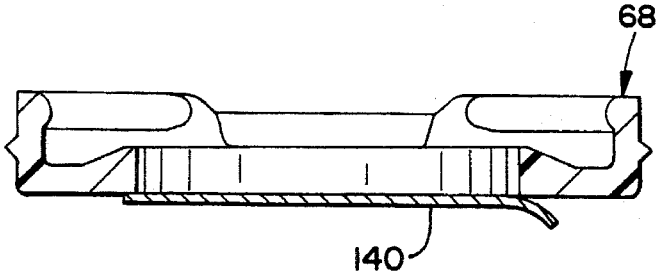
FIG. 23 is a view similar to FIG. 22, but FIG. 23 illustrates a second embodiment of a closure having an alternate embodiment of the cartridge retainer tear-away seal.

Alternatively, the central opening in the cartridge as illustrated in FIG. 4—which provides access to the valve 70—could be covered with any other suitable seal. For example, FIG. 23 illustrates the use of a flexible, disk-like seal 140 which is adhesively attached to the flat, exterior, end surface of the retainer 68.

Another form of a closure incorporating the principles of the present invention is illustrated in FIGS. 24 and 25. A closure 142 has a generally rectangular configuration and is disposed on the top of a container 144.

The container 144 has a neck 146. The neck 146 is covered on two opposing sides and at the rear by a shroud 148.

The closure 142 includes a deck 150 with a downwardly depending front wall 152. The deck 150 defines an opening 154, and a collar 156 depends downwardly from the underside of the deck 150 around the container neck 146. The distal end of the closure collar 156 includes an inwardly projecting bead 158 for engaging an outwardly projecting bead 160 on the container neck 146.

A cartridge 164 is mounted within the closure collar 156 at the top of the container neck 146. The closure 164 includes a body 166 and a retainer 168 engaged around a valve 170. The cartridge body 166, retainer 168, and valve 170 may be substantially identical to the body 66, retainer 68, and valve 70 described above with reference to the first embodiment of the cartridge 64 illustrated in FIGS. 1–22.

The cartridge 164 is retained via a friction-fit or snap-fit engagement with the inside surface of the closure housing collar 156. The closure housing deck 150 extends directly over the peripheral portion of the retainer 168. The cartridge 164 does not include the pull tab 102 and central portion 104 employed in the cartridge 64 described above with reference to the cartridge 64 illustrated in FIGS. 1–22. Instead, the closure has a hinged lid 171 with a downwardly projecting, annular, restraint member 173. When the lid 171 is closed (in the position illustrated in FIG. 24), the annular restraint member 173 is positioned relative to the valve 170 in a manner similar to the positioning of the first embodiment restraint member 112 relative to the valve 70 as described above with reference to FIGS. 1–22.

Figure 28:
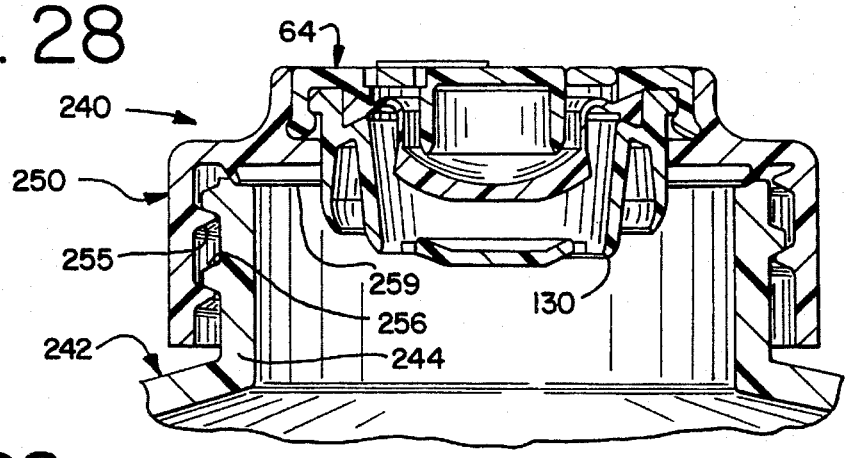
FIG. 28 is a fragmentary, cross-sectional view of the closure shown in FIGS. 26 and 27 installed on a container.

FIGS. 26–28 illustrate another embodiment of a closure 240 incorporating the principles of the present invention. As shown in FIG. 28, a closure is adapted to be mounted on the neck 2.44 of a container 242. The container neck 244 has threads 256, and the closure 240 has threads 255 for engaging the container neck threads.

The closure neck threads 255 are defined in a housing 250 which receives a cartridge 264. The cartridge 64 is identical to the cartridge 64 described above with reference to the first embodiment of the closure illustrated in FIGS. 1–22. The relationship of the cartridge 64 with the housing 250 is somewhat different in the closure 240 compared with the relationship of the cartridge 64 with the housing 50 in the closure 40 illustrated in FIGS. 1–22. In particular, the closure 240 has a maximum diameter which is greater than the cartridge 64 for engaging a larger diameter neck 244 of the container 242. As a consequence, the inside cylindrical surface of the container neck 244 is not engaged by the cartridge collar 130. This is in contrast with the first embodiment closure cartridge wherein the collar 130 engages the inside, cylindrical surface of the container neck 44 as shown in FIGS. 5, 9, and 10. Instead, as shown in FIG. 28, the housing 250 has a downwardly projecting, flexible seal member 259 which engages the top, annular surface of the container neck 244 to provide a seal.

Figure 29:
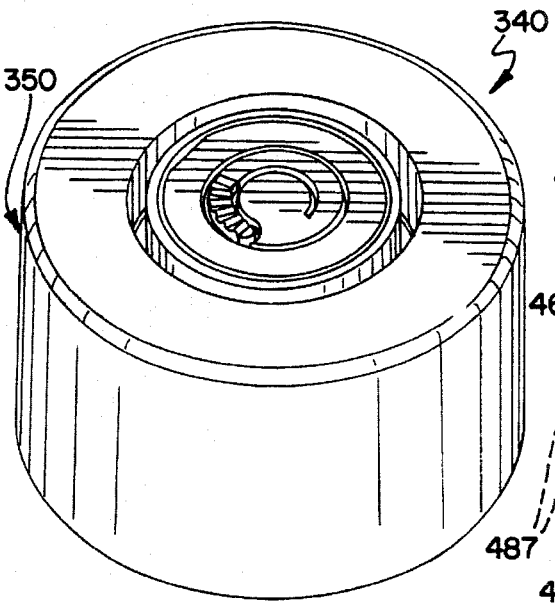
FIG. 29 is a perspective view of a fifth embodiment of a closure of the present invention.
Figure 30:
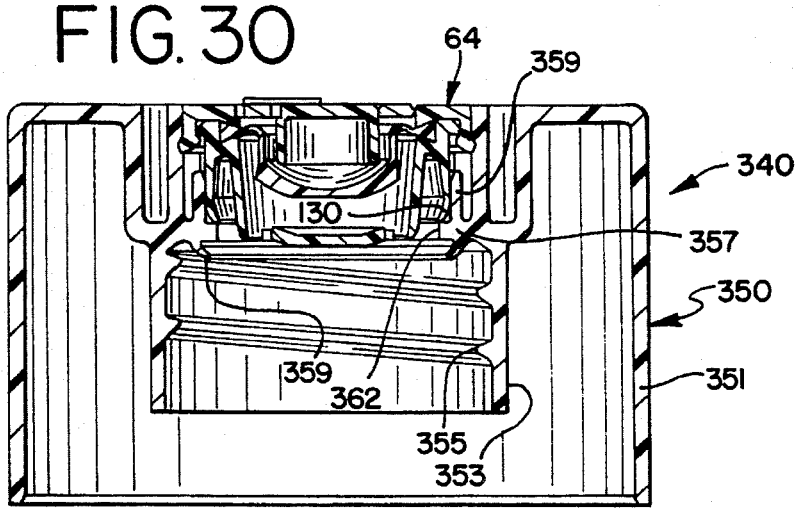
FIG. 30 is a cross-sectional view of the fifth embodiment of the closure illustrated in FIG. 29.

It will be appreciated by comparing FIG. 28 with FIG. 5 that a standardized cartridge 64 may be employed in housings having different diameters (and different container engagement configurations). Indeed, another embodiment of a closure, with still a different container engagement configuration, is illustrated in FIGS. 29 and 30 wherein the closure is generally designated by the reference number 340.

The closure 340 includes a housing 350 having an outer, cylindrical wall 351 and an inner, cylindrical wall 353. The inside surface of the cylindrical wall 353 defines a thread 355 for engaging a mating thread on the neck of a container (not shown).

The housing 350 also defines a recessed deck 357 defining an opening 362 affording communication between the container and the exterior of the housing. Projecting upwardly from the deck 357 is a collar 359. The collar 359 is a generally cylindrical wall disposed radially outwardly of the opening 362.

The housing 350 receives a cartridge 64 identical to the cartridge 64 described above with reference to the first embodiment of the closure illustrated in FIGS. 1–22. The cartridge 64 includes the above-described, downwardly depending collar 130, and the outside surface of the collar 130 sealingly engages the inside surface of the closure collar 359 to establish a seal. Another seal is established between the bottom of the closure deck 357 and the top of the container neck with a flexible annular seal member 359 which extends downwardly from the deck 357 as shown in FIG. 30.

Figure 31:
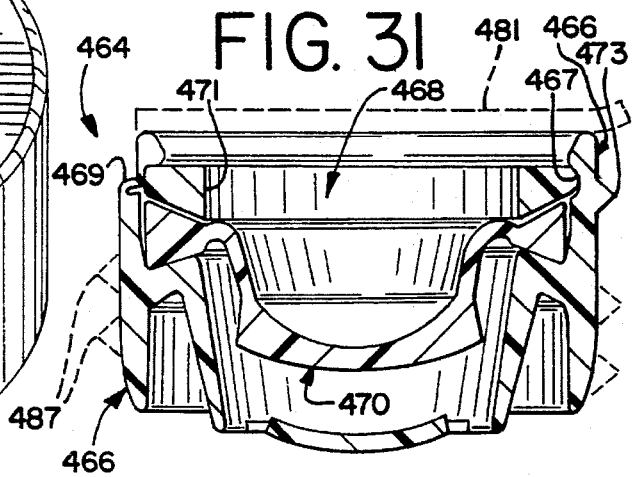
FIG. 31 is an alternate embodiment of a cartridge for use for the closure of the present invention.

The cartridge 64 can be modified according to the principles of the present invention, and FIG. 31 illustrates such a modification wherein the modified cartridge is designated generally by the reference number 464. The cartridge 464 includes a body 466 molded in a unitary construction with a retainer 468 which is connected to the body 466 with a flexible strap or hinge 469. The retainer 468 has a ring-like configuration defining a central opening 471. A valve 470 is retained in the body 466 by the retainer 469 which is snap-fit into a groove 467 in the body 466. The valve 470 may be identical or substantially identical to the valve 70 described above with reference to the embodiment illustrated in FIGS. 1–22.

In one contemplated embodiment, the opening 471 in the retainer 468 is not covered with a seal, such as the pull tab 102 and central portion cover 104 described above with reference to the embodiment illustrated in FIGS. 1–22. Thus, the cartridge 464 illustrated in FIG. 31 may be used immediately to dispense the product from the container through the valve 470 without having to remove a seal structure or other closure component.

The cartridge body 466 defines a bead 473 which extends at least part way around the periphery of the body 466 for engaging a mating groove in a closure housing so as to effect the mounting of the cartridge 464 in such a closure housing. The bead 473 is thus functionally analogous to the bead 98 on the first embodiment of the cartridge 64 which is received in the housing groove 100 as illustrated in FIG. 5. However, it will be appreciated that in the embodiment of the cartridge 464 illustrated in FIG. 31, the cartridge bead 473 is defined by the body 466, and not by the retainer. This is in contrast with the cartridge 64 illustrated in FIG. 5 wherein the bead is defined on the retainer 68.

The cartridge 464 illustrated in FIG. 31 may be modified. For example, the top of the body 466 may be covered with an adhesively secured, removable sealing member 481 as illustrated in dotted lines in FIG. 31. Such a removable sealing member 481 would serve a function analogous to that of the removable member 140 described above with reference to the embodiment illustrated in FIG. 23. In particular, the member 481 would provide an additional barrier between the container contents and the exterior of the closure. The member 481 could also serve as a tamper-evident feature.

The cartridge 464 may be modified in other ways also. For example, the cartridge 464 may be provided with exterior threads 487 as illustrated in dotted lines in FIG. 31. Such threads could be employed with a special container having an internally threaded neck for securing the cartridge directly to the container. The cartridge 464, as thus modified, would, in effect, become a complete closure for the container.

Further, the cartridge 464 could be provided with an additional, outer cylindrical wall (not illustrated) that is spaced beyond, and is concentric with, the cylindrical wall of the body 466 illustrated in FIG. 31. The inner surface of such an additional, outer wall could be provided with an internal thread for engaging a conventional exterior thread on the neck of a conventional container. Such a modified cartridge would also become, in effect, a complete closure for the container.

Further, it will also be appreciated that a closure may be provided with a cartridge, such as the cartridge 64 illustrated in FIGS. 1–22, wherein the body 66 and retainer 68 are not molded together as a unitary piece. In such a modification, the hinge 69 (FIG. 16) would be eliminated, but the other features of the cartridge would be retained so as to still provide a novel, standardized, self-contained cartridge for mounting in a housing of a closure. Such a hingeless cartridge may or may not include a seal member, such as the seal member 140 illustrated in FIG. 23 or such as the pull tab 102 and central portion 104 illustrated in FIG. 2.

It will be readily observed from the foregoing detailed description of the invention and from the illustrations thereof that numerous other variations and modifications may be effected without departing from the true spirit and scope of the novel concepts or principles of this invention.

What is claimed is:

1. A cartridge for being received and retained in a hollow closure housing suitable for engagement with a container around an opening to the container interior, said cartridge comprising:

a body defining a dispensing passage for communicating with the container exterior and interior when said cartridge is received in said housing on said container;

a valve seated in said body for shifting between a closed configuration occluding said passage and an open configuration accommodating the dispensing of the container contents through said passage; and a retainer engaged with said body to hold said retainer and body in a clamping relationship retaining said valve in said body, said retainer and body cooperating to maintain said engagement independently of said housing.

2. The cartridge in accordance with claim 1 in which said cartridge further includes a hinge molded unitary with, and connecting, said body and retainer.

3. The cartridge in accordance with claim 1 in which said body defines a generally annular seat for said valve;

said valve has a generally annular flange disposed on said seat; and said retainer has a generally annular engaging surface for engaging said valve flange and holding it against said seat.

4. The cartridge in accordance with claim 1 in which one of said body and retainer defines an annular groove; and the other of said body and retainer defines an annular bead having a convex surface received in said groove in a snap-fit engagement.

5. A closure for an opening to a container interior, said closure comprising:

a body for being positioned on said container at said opening, said body defining a dispensing passage for communicating between the container exterior and interior;

a valve seated in said body for shifting between a closed configuration occluding said passage and an open configuration accommodating the dispensing of the container contents through said passage; and a hinge and retainer extending from said hinge molded unitary with said body to permit said retainer to be swung by said hinge into engagement with said body, said retainer being engaged with said body at least one location separate from said hinge to hold said retainer and body in a clamping relationship retaining said valve in said body.

6. The closure in accordance with claim 5 in which said body defines one of a snap-fit bead and a thread for engaging a mating structure on said container.

7. The closure in accordance with claim 5 in which said closure further includes a hollow housing engageable with said container around said container opening; and said body, valve, hinge, and retainer are disposed in said housing with said retainer in a snap-fit engagement with said housing thereby holding the body, valve, hinge, and retainer together with said housing.

8. The closure in accordance with claim 5 in which said retainer has a ring defining a central aperture accommodating the dispensing of the container contents through said aperture from said valve.

9. The closure in accordance with claim 5 in which one of said body and retainer defines an annular groove open radially; and the other of said body and retainer defines an annular bead having a convex surface extending radially and received in said groove in a snap-fit engagement.

10. The closure in accordance with claim 5 in which said body defines a generally annular seat for said valve;

said valve has a generally annular flange disposed on said seat; and said retainer has a generally annular engaging surface for engaging said valve flange and holding it against said seat.

11. The closure in accordance with claim 5 in which said closure further includes a removable seal across said retainer to prevent the dispensing of the container contents.

12. A closure for an opening to a container interior, said closure comprising:

a hollow housing for engaging said container around said opening and defining an interior receiving structure; and a cartridge which is separate from, and disposed, in said housing receiving structure, said cartridge including (a) a body defining a dispensing passage for communicating with the container exterior and interior when said cartridge is received in said housing on said container;

(b) a valve seated in said body for shifting between a closed configuration occluding said passage and an open configuration accommodating the dispensing of the container contents through said passage; and (c) a retainer engaged with said body to hold said retainer and body in a clamping relationship retaining said valve in said body, said retainer and body cooperating to maintain said engagement independently of said housing.

13. A cartridge for being received and retained in a hollow closure housing suitable for engagement with a container around an opening to the container interior, said cartridge comprising:

a body defining a dispensing passage for communicating with the container exterior and interior when said cartridge is received inside said housing on said container;

a valve seated in said body for shifting between a closed configuration occluding said passage and an open configuration accommodating the dispensing of the container contents through said passage; and a retainer engaged with said body inside said body to hold said retainer and body in a clamping relationship retaining said valve in said body, said retainer and body cooperating to maintain said engagement independently of said housing.

14. A cartridge for being received and retained in a hollow closure housing suitable for engagement with a container around an opening to the container interior, said cartridge comprising:

a body defining a dispensing passage for communicating with the container exterior and interior when said cartridge is received in said housing on said container, said body adapted to be mounted to the inside of said housing from the bottom of said housing;

a valve seated in said body for shifting between a closed configuration occluding said passage and an open configuration accommodating the dispensing of the container contents through said passage; and a retainer engaged with said body to hold said retainer and body in a clamping relationship retaining said valve in said body, said retainer and body cooperating to maintain said engagement independently of said housing.

15. A closure for an opening to a container interior, said closure comprising:

a hollow housing for engaging said container around said opening and defining an interior receiving structure; and a cartridge which is separate from, and disposed inside, said housing interior receiving structure, said cartridge including (a) a body defining a dispensing passage for communicating with the container exterior and interior when said cartridge is received in said housing on said container;

(b) a valve seated in said body for shifting between a closed configuration occluding said passage and an open configuration accommodating the dispensing of the container contents through said passage; and (c) a retainer engaged with said body inside said body to hold said retainer and body in a clamping relationship retaining said valve in said body, said retainer and body cooperating to maintain said engagement independently of said housing.

16. A closure for an opening to a container interior, said closure comprising:

a hollow housing for engaging said container around said opening and defining an interior receiving structure; and a cartridge which is separate from, and disposed in, said housing interior receiving structure, said cartridge including (a) a body defining a dispensing passage for communicating with the container exterior and interior when said cartridge is received in said housing on said container, said body adapted to be mounted to the inside of said housing interior receiving structure from the bottom of said housing;

(b) a valve seated in said body for shifting between a closed configuration occluding said passage and an open configuration accommodating the dispensing of the container contents through said passage; and (c) a retainer engaged with said body to hold said retainer and body in a clamping relationship retaining said valve in said body, said retainer and body cooperating to maintain said engagement independently of said housing.

* * * * *